US006629505B1

(12) United States Patent
Cronk et al.

(10) Patent No.: US 6,629,505 B1
(45) Date of Patent: Oct. 7, 2003

(54) CONFERENCE TABLE WITH CENTRAL UTILITY SYSTEM

(75) Inventors: Jeffrey P Cronk, Tulsa, OK (US); Ting-Wen Nieh, Arlington, TX (US); Kevin S. Wilson, Grand Prairie, TX (US); Robert L. Stewart, Grapevine, TX (US); James B. Lowell, Arlington, TX (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/918,953

(22) Filed: Jul. 31, 2001

Related U.S. Application Data

(63) Continuation of application No. 09/261,406, filed on Mar. 3, 1999, now Pat. No. 6,327,983.

(51) Int. Cl.[7] ..... A47B 37/00
(52) U.S. Cl. ..... 108/50.02; 312/223.6
(58) Field of Search ..... 108/50.01, 50.02, 108/25, 26; 312/194, 223.3, 223.6

(56) References Cited

U.S. PATENT DOCUMENTS 3,367,290 A 2/1968 Barecki
3,635,174 A 1/1972 Ball et al.

(List continued on next page.)

OTHER PUBLICATIONS

Exhibit A is a brochure entitled *Powered Conference Tables* by Bretford (7 pages) disclosing a prior art table shown in Jun. 1997.
Exhibit B is a brochure entitled *More Power to You* by Nucraft (4 pages) dated Oct. 1998.
Exhibit C is a brochure entitled *Gathering Places for the Wired Age* by Nucraft (12 pages) dated Dec. 1998.

*Primary Examiner*—James O. Hansen
*Assistant Examiner*—Jerry A. Anderson
(74) *Attorney, Agent, or Firm*—Price, Heneveld, Cooper, DeWitt & Litton

(57) ABSTRACT

A conference table includes a work surface having one or more central openings. A utility distribution system is positioned below the central opening on a support channel. The support channel defines separated wireways for communicating separated utilities along the support channel. The utility distribution system further includes a plurality of W-shaped utility modules positioned on beams of the support channel below the central opening. The utility modules set end-to-end in an arrangement that facilitates initial installation and later retrofit or repair. The table is supported on legs that define a vertical wireway space, and further include a repositionable divider configured to selectively subdivide the vertical wireway space into subwireways of different cross-sectional sizes for accommodating different cross-sectional sizes of utility conduit bundles. A removable double-pivoted door is releasably supported to cover the opening and to provide easy access to the opening from either side of the tabletop.

21 Claims, 16 Drawing Sheets

U.S. PATENT DOCUMENTS

| | | | |
|---|---|---|---|
| 4,094,256 | A | 6/1978 | Holper et al. |
| 4,296,981 | A | 10/1981 | Hildebradt et al. |
| 4,345,803 | A | 8/1982 | Heck |
| 4,562,482 | A | 12/1985 | Brown |
| 4,654,756 | A | 3/1987 | Wilson et al. |
| 4,735,467 | A | 4/1988 | Wolters |
| 4,762,072 | A | 8/1988 | Boundy et al. |
| 4,766,422 | A | 8/1988 | Wolters et al. |
| 4,792,881 | A | 12/1988 | Wilson et al. |
| 4,828,342 | A | 5/1989 | Stefan |
| 4,852,500 | A | 8/1989 | Ryburg et al. |
| 4,884,513 | A | 12/1989 | Newhouse et al. |
| 4,948,205 | A | 8/1990 | Kelley |
| 5,037,164 | A | 8/1991 | Weissenbach et al. |
| 5,065,832 | A | 11/1991 | Mark |
| 5,083,512 | A | 1/1992 | Newhouse et al. |
| 5,154,126 | A | 10/1992 | Newhouse et al. |
| 5,160,188 | A | 11/1992 | Rorke et al. |
| 5,226,705 | A | 7/1993 | Rorke et al. |
| 5,231,562 | A | 7/1993 | Pierce et al. |
| 5,237,935 | A | 8/1993 | Newhouse et al. |
| 5,357,874 | A | 10/1994 | Palmer |
| 5,429,431 | A | 7/1995 | Olson et al. |
| 5,437,235 | A | 8/1995 | Randolph |
| 5,451,101 | A | 9/1995 | Ellison et al. |
| 5,480,224 | A | 1/1996 | Uglade |
| 5,526,756 | A | 6/1996 | Watson |
| 5,568,773 | A | 10/1996 | Hung |
| 5,606,920 | A | 3/1997 | Meyer et al. |
| 5,611,608 | A | 3/1997 | Clausen |
| 5,638,759 | A | 6/1997 | Klugkist |
| 5,673,632 | A | 10/1997 | Sykes |
| 5,694,861 | A | 12/1997 | Laukamm-Josten |
| 5,699,255 | A | 12/1997 | Yavitz et al. |
| 5,709,156 | A | 1/1998 | Gevaert et al. |
| 5,715,761 | A | 2/1998 | Frattini |
| 5,752,449 | A | 5/1998 | Simon et al. |
| 5,758,934 | A | 6/1998 | Flutka et al. |
| 5,763,985 | A | 6/1998 | Asinovsky |
| 6,202,567 | B1 | 3/2001 | Funk et al. |

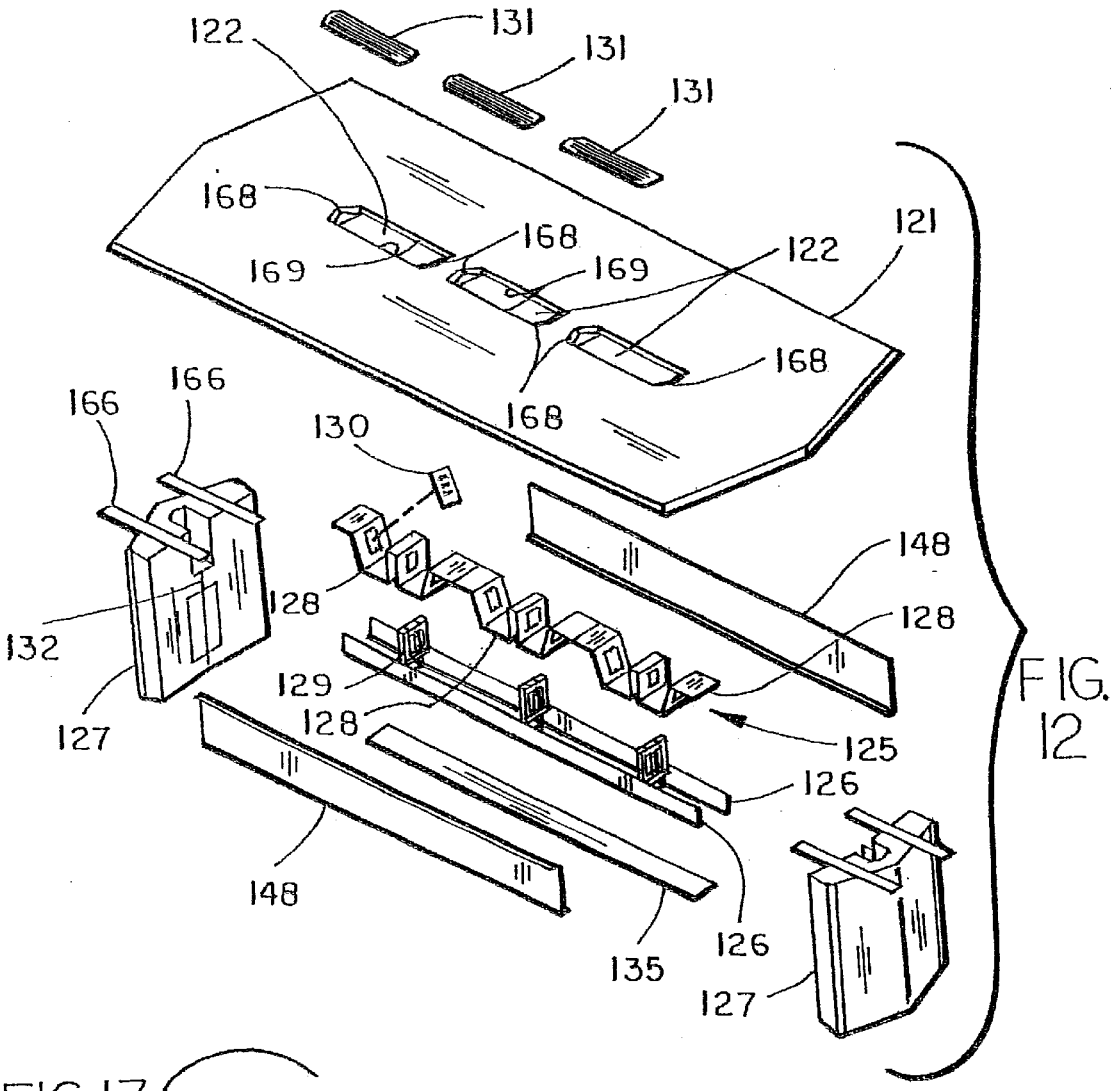
FIG. 12
FIG. 13
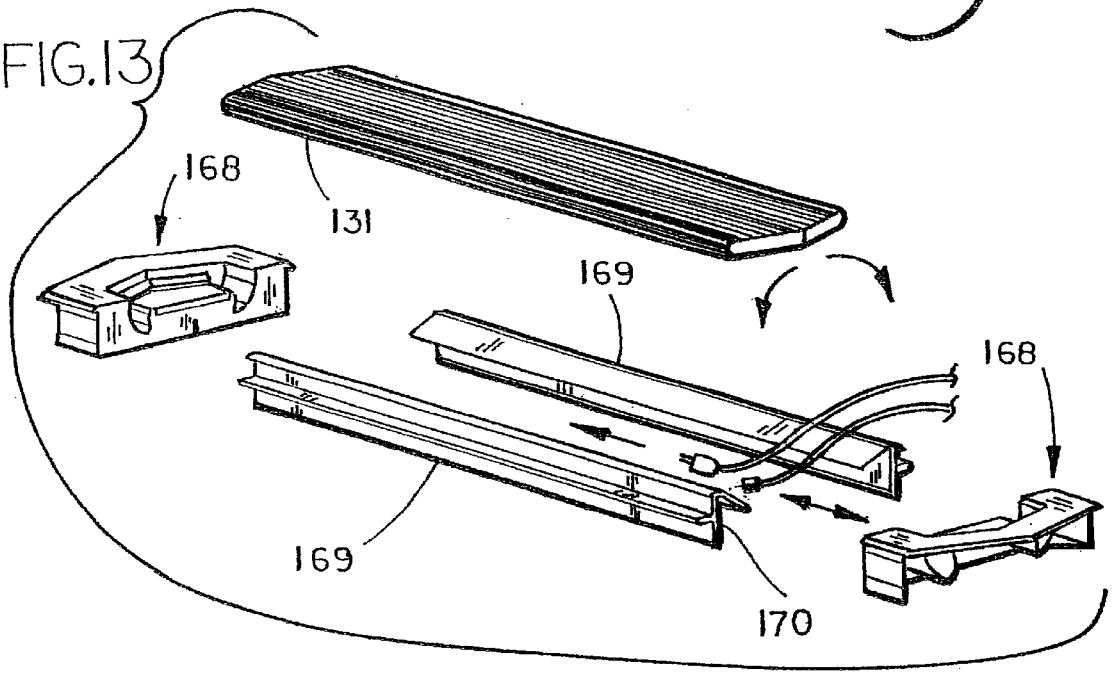

CONFERENCE TABLE WITH CENTRAL UTILITY SYSTEM

CROSS-REFERENCE TO RELATED APPLICATION

The present application is a continuation of U.S. application No. 09/261,406, filed on Mar. 3, 1999, entitled CONFERENCE TABLE WITH CENTRAL UTILITY SYSTEM, now U.S. Pat. No. 6,327,983.

BACKGROUND OF THE INVENTION

The present invention relates to conference tables, and more particularly to conference tables adapted to support conferencing equipment, such as electronic, video, audio, and networking utilities.

Meetings, conferences, and seminars are recently making greatly increased use of electronic and communicative devices. However, furniture must evolve to handle the increased density and capabilities of such devices in a user-friendly way. This means that the furniture must do more than simply provide power and telephone lines, but further it must provide easy access to these and additional utilities in a manner allowing attendees of the meetings to attach their personal computers and electronic devices to the lines and utilities provided. Notably, the utilities may include such things as wiring for supporting portable computers, video sending and/or receiving/display devices, audio sending and/or receiving devices, devices permitting networking and/or that support other intercommunication activities, combinations thereof, and the like. When so many different utilities and lines exist, a tangled mass quickly develops, where wires become hopelessly tangled and have a poor appearance. Further, many lines need to be separated, such as power wiring and telecommunication wiring. At the same time, the furniture should preferably allow repairmen to quickly access the utility outlets for repair, reconfiguration, and the addition of new lines.

Accordingly, a conference table solving the aforementioned problems and having the aforementioned advantages is desired.

SUMMARY OF THE INVENTION

In one aspect of the present invention, a conference table includes a leg assembly including first and second legs and a beam connected between and stabilizing the first and second legs, a utility distribution system supported by the beam including utility outlets, and a tabletop supported by the leg assembly, including an elongated central opening over the beam for accessing the utility outlets.

In another aspect of the present invention, a conference table includes a tabletop having an elongated central opening dividing the tabletop into opposing sections, a cross beam extending under the central opening, and a plurality of utility modules positioned on the cross beam that have utility outlets positioned below the elongated central opening. The utility modules set end-to-end along the beam.

In another aspect of the present invention, a table includes a tabletop including an opening, a cover shaped to cover the opening, and a cover support operably supporting the cover for opening movement in either of two different directions. In a narrower form, the cover support includes end pieces having a cover-supporting surface constructed to support the cover in a horizontal closed position over the opening. In one form, the cover support includes at least one recess configured to receive an edge of the cover as the cover is pivoted to an open position.

In yet another aspect of the present invention, a conference table includes a tabletop, a utility distribution system associated with the tabletop, and at least one tubular leg supporting the tabletop. The tubular leg defines an internal space. The conference table further includes a repositionable adjustable divider adjustably attached to the tubular leg in the internal space. The divider is selectively repositionable to a plurality of different positions to subdivide the internal space into at least two differently sized wireways for routing separated utilities therein.

These and other features, objects, and advantages of the present invention will become apparent to a person of ordinary skill upon reading the following description and claims together with reference to the accompanying drawings.

DESCRIPTION OF THE FIGURES

FIG. 5 is an exploded view of the utility distribution system shown in FIG. 1;

FIG. 12 is an exploded perspective view of the conference table shown in FIG. 10;

FIG. 13 is an exploded view of the cover arrangement shown in FIG. 12;

DETAILED DESCRIPTION OF PREFERRED EMBODIMENT

Figure 1:
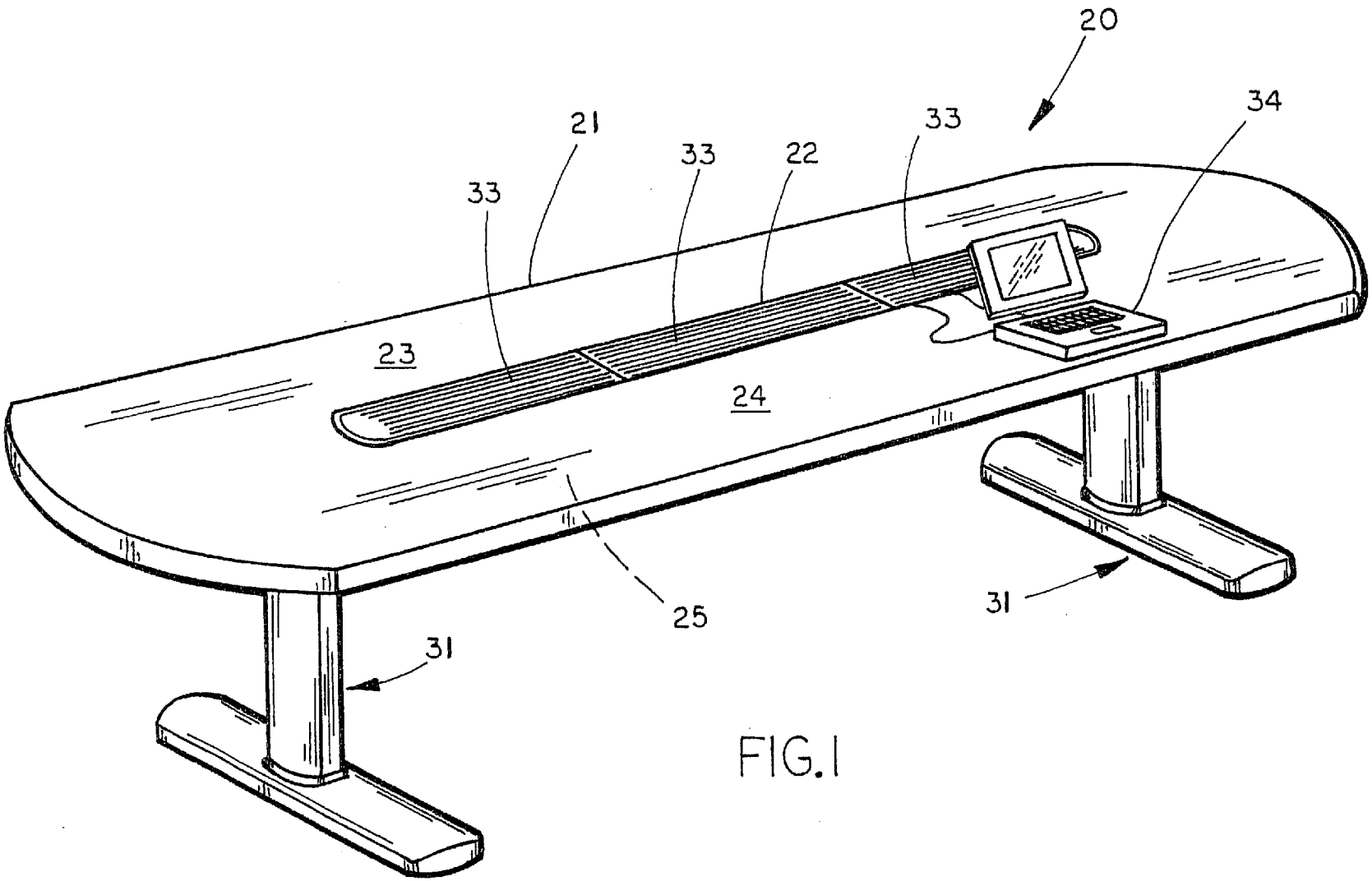
FIGS. 1–3 are perspective views of a conference table embodying the present invention, FIG. 1 showing the table with a portable laptop computer connected to its centrally located utility distribution system, FIG. 2 showing the utility distribution system as if the tabletop and beam of the conference table were transparent, and FIG. 3 showing a module of the utility distribution system pulled out of a center of the tabletop for repair.
Figure 2:
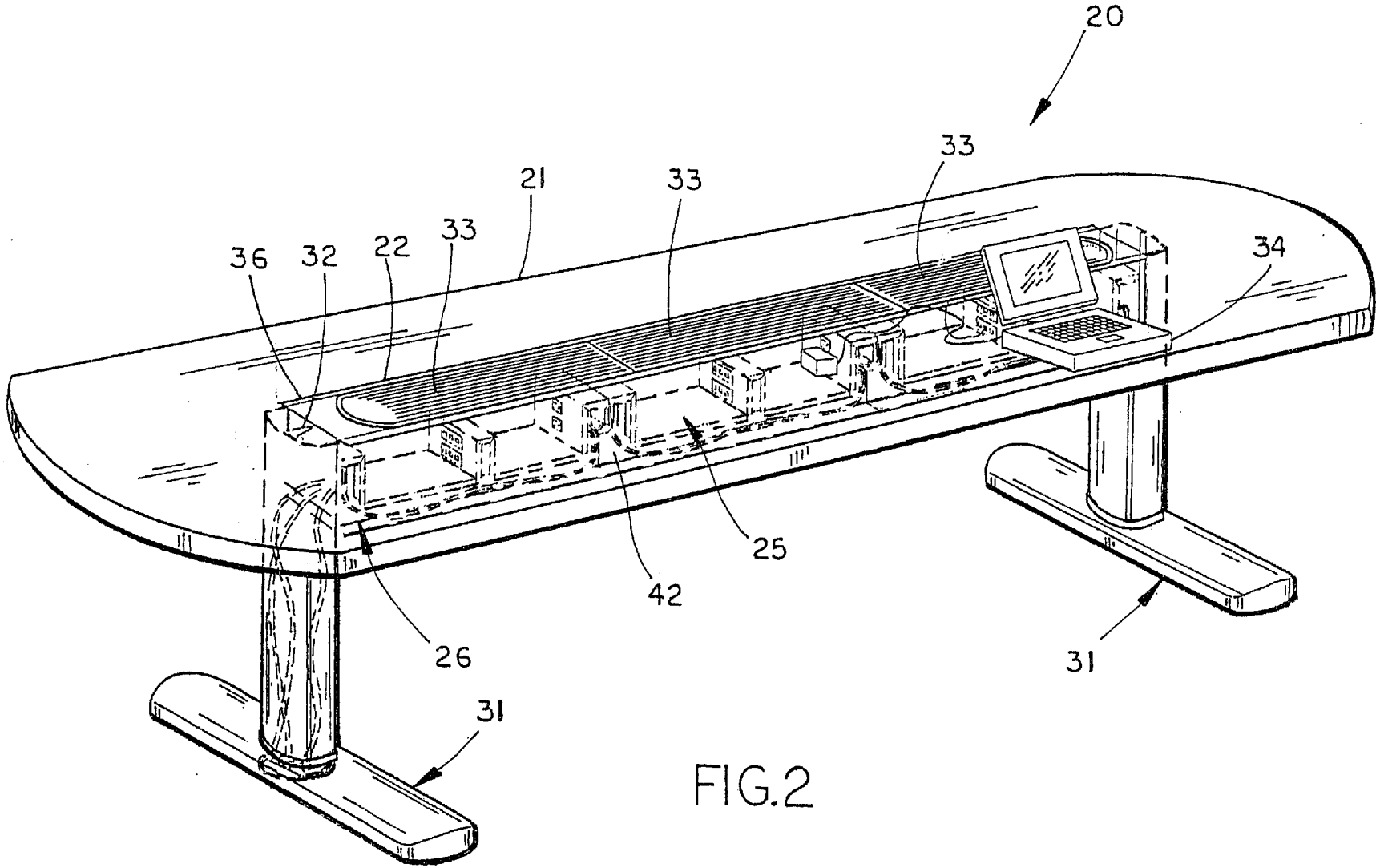
Figure 3:
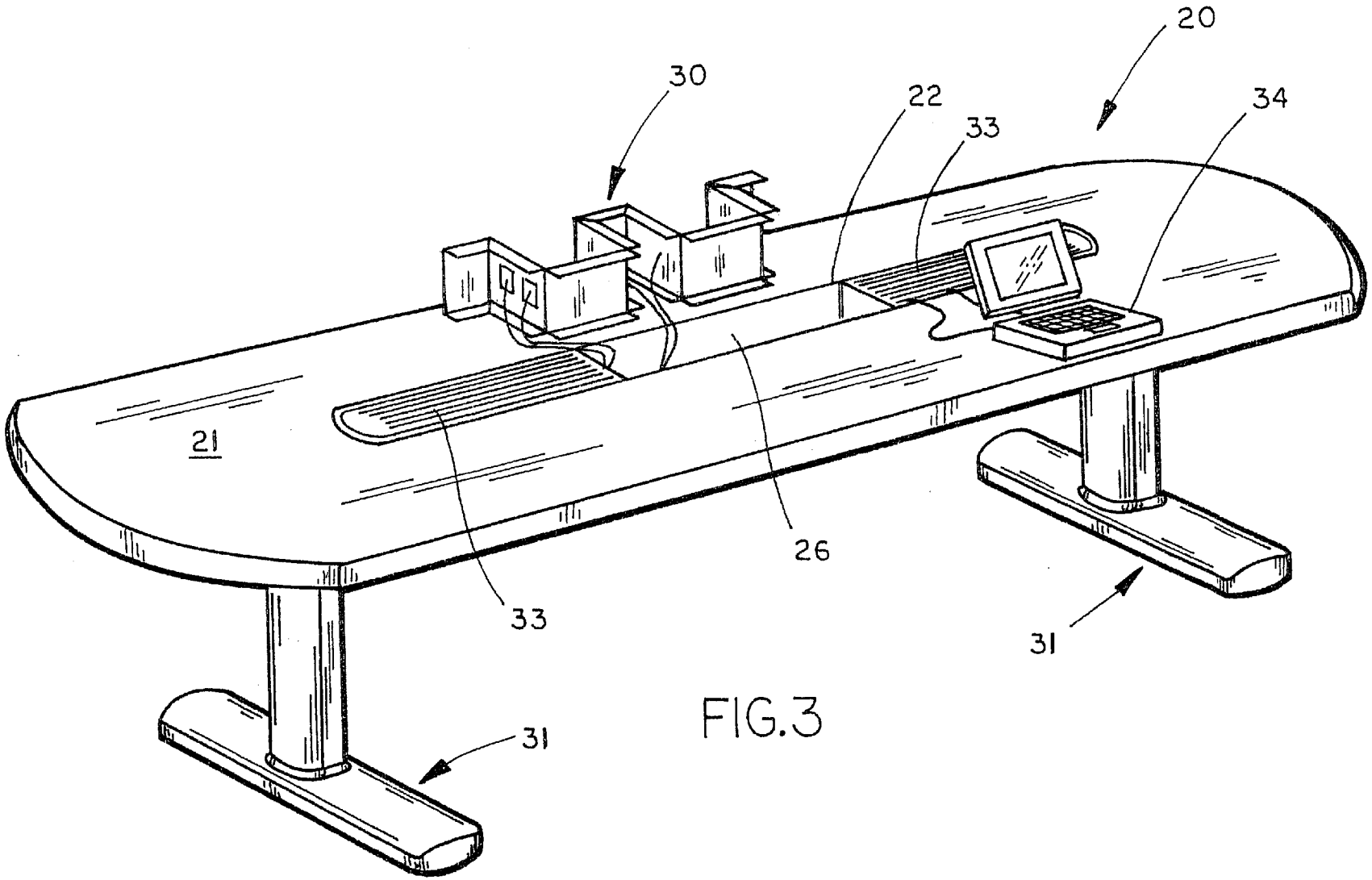
Figure 4:
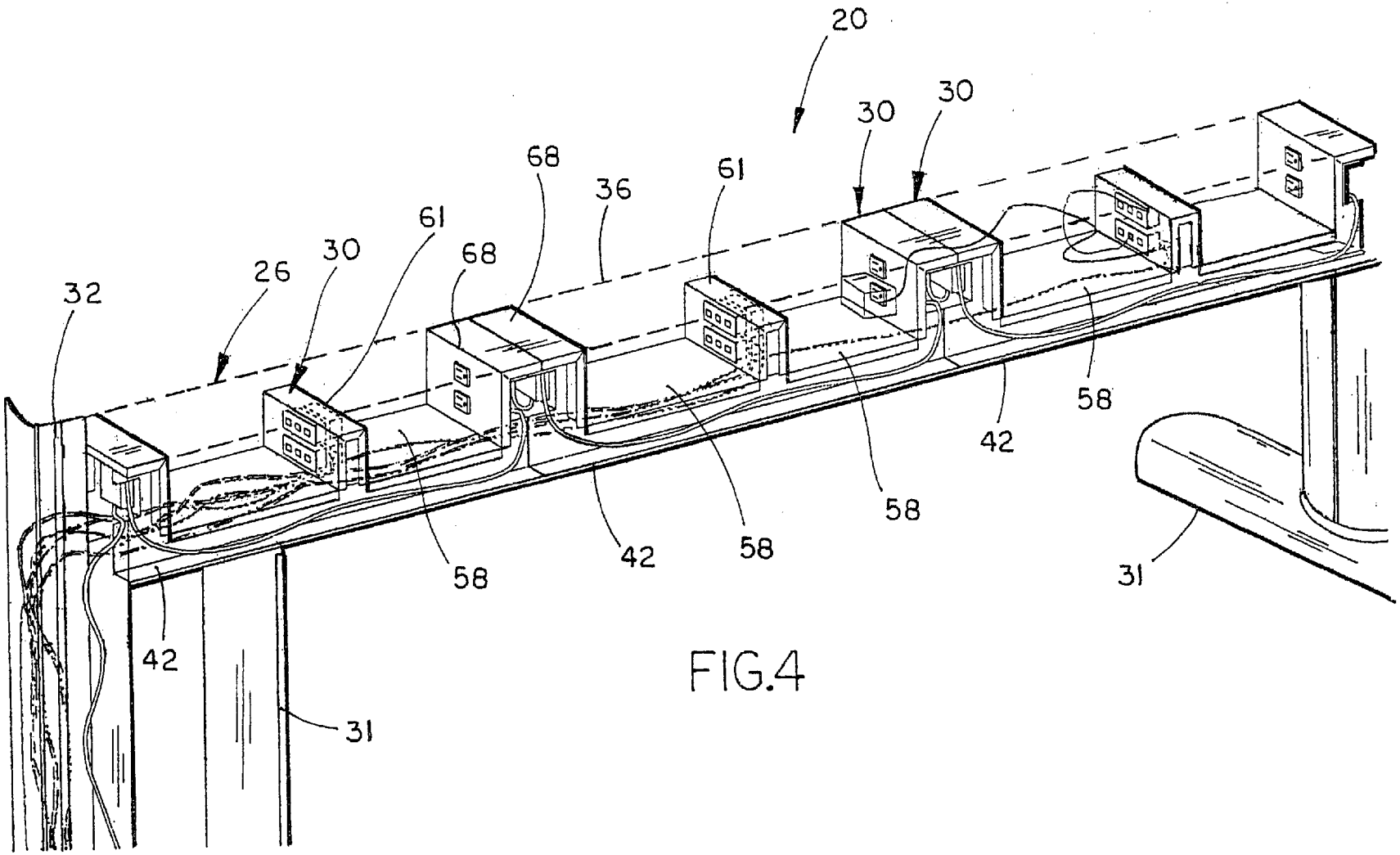
FIG. 4 is an enlarged perspective view of the utility distribution system shown in FIG. 2.
Figure 4A:
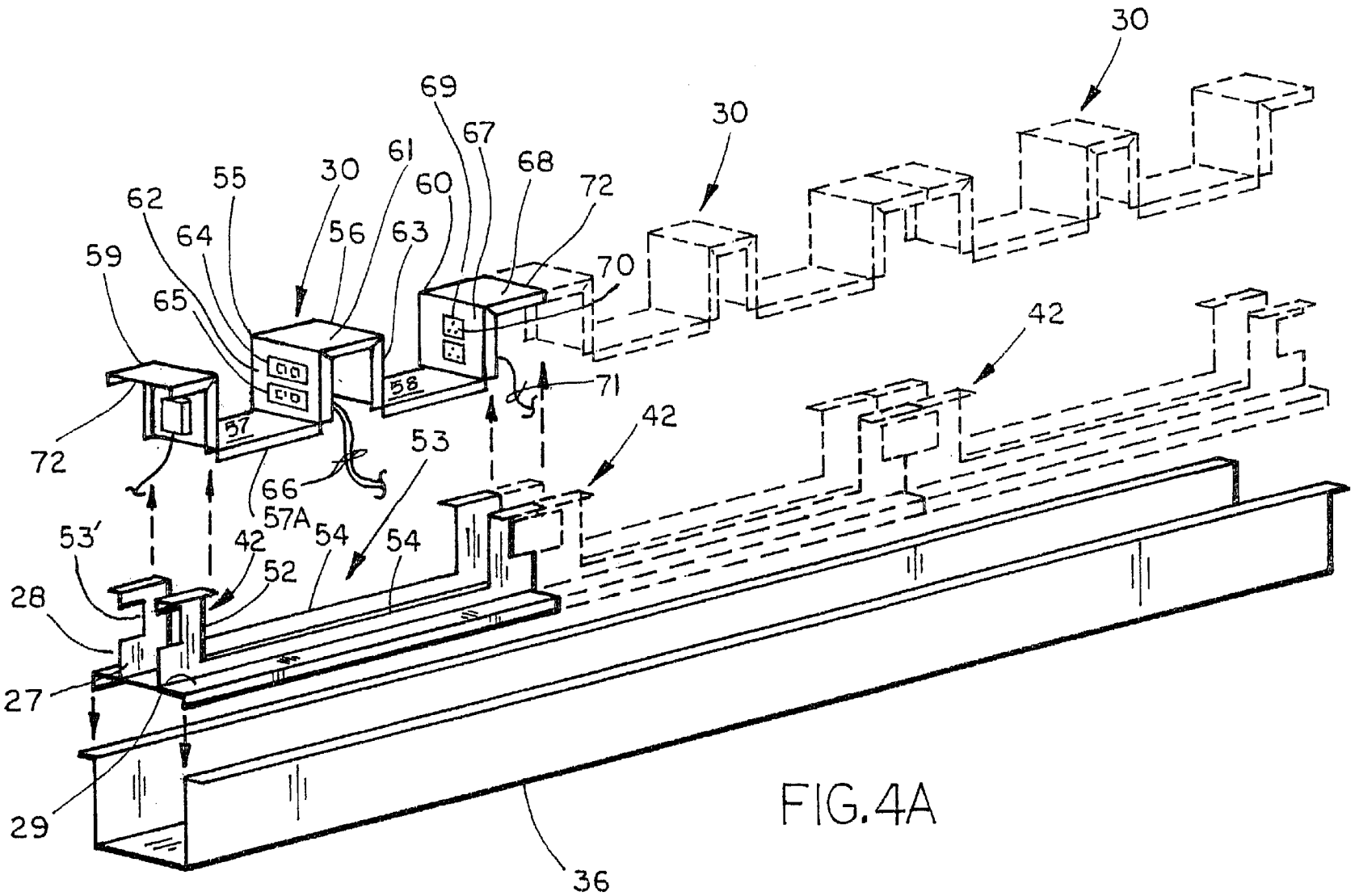
FIG. 4A is as exploded perspective view of the utility distribution system shown in FIG. 4.
Figure 9:
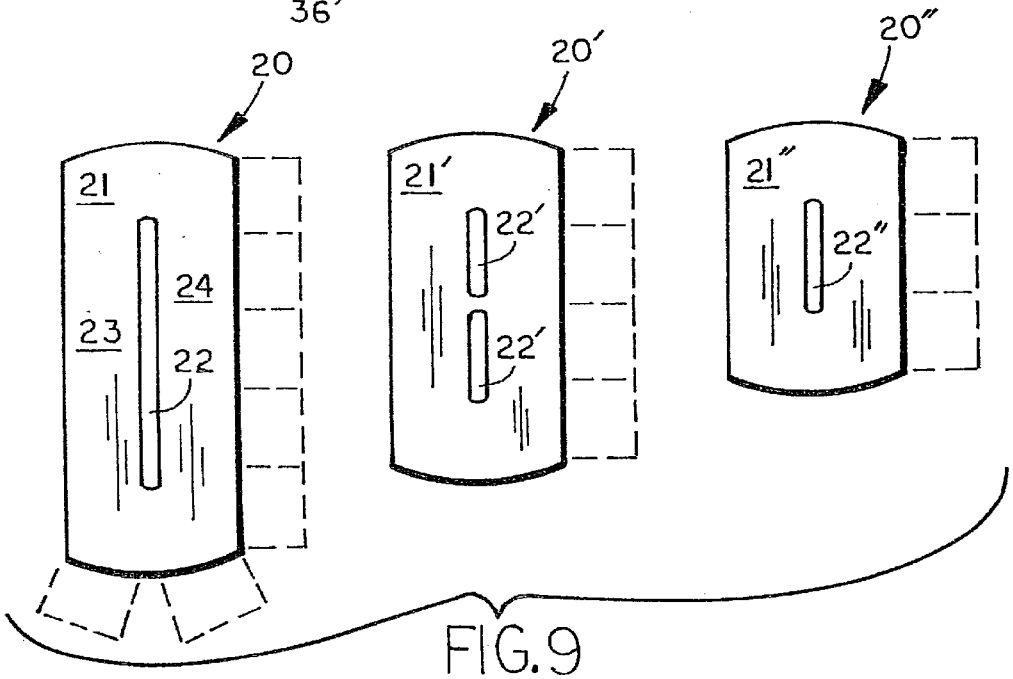
FIG. 9 is a top view of three differently sized tabletop constructions similar to the tabletop construction of FIG. 1.

A conference table 20 (FIG. 1) embodying the present invention includes an elongated work surface 21 having an elongated central opening 22 covered by covers 33 that divide the work surface 21 into opposing half sections 23 and 24. Each opposing half section 23 and 24 (FIG. 9) includes at least one work area, such as about 28 inches wide and deep/large enough for a person to work at while in a conference. A utility distribution system 25 (FIG. 2) is positioned below the elongated central opening 22 in a support channel 26. The support channel 26 (FIG. 4A) includes a U-shaped beam 36 between legs 31, and further includes stands 42 having dividers 54 that subdivide the space in beam 36 into a central wireway 27 (FIG. 5) and opposing side wireways 28 and 29 for communicating separated utilities along the support channel 26. A plurality of removable utility modules 30 are positioned in the support channel 26 below the elongated central opening 22 for easy access. The utility modules 30 set end-to-end in the U-shaped beam 36, but are configured to be individually pulled out (see FIG. 3) and set on the work surface 21 on either side of the central opening 22 to facilitate reconfiguration and rewiring. Removable and pivotable channel covers 33 cover the support channel 26 to provide an aesthetically covered arrangement that is visually very clean. By this arrangement, each person at a conference can reach into the support channel 26 to connect to the utility outlets in the utility distribution system 25 (FIG. 1) from above the work surface 21 for operating or receiving individual utility-connected devices 34 for the conference. Characteristically, people can easily and ergonomically access and connect to the utility outlets without having to reach awkwardly under an edge of the work surface 21. Advantageously, the table 20 is supported on tubular legs 31 that define a divided vertical wireway space for communicating the utilities to a floor. The tubular legs 31 are divided by a repositionable divider 32 configured to make subwireways of different cross-sectional sizes for accommodating different cross-sectional sizes of utility conduit bundles.

The work surface 21 (FIG. 9) is made as long as desired (or two abutting tables are used) for seating several people along its length and around its ends. For example, worksurface 21 ergonomically accommodates a conference of fourteen people, while worksurface 21' of conference table 20' accommodates about twelve people, and worksurface 21" of conference table 20" accommodates about ten people. Further, the work surface 21 is wide enough to provide each person with a good-sized work area sufficient to permit each person to spread out papers and/or operate a conferencing device, such as laptop computer 34, in the work area for use while conferencing. It is contemplated that any number of different utilities can be provided for the conferencing devices 34, including such things as wiring for supporting portable computers, calculating devices, video sending and/or receiving/display devices, audio sending and/or receiving devices, devices capable of networking and/or that support other intercommunication activities, combinations thereof, and the like. In large tables, one long opening 22 or several shorter openings can be used. Also, a plurality of smaller openings can be irregularly spaced at optimal locations (see table 20°).

The central opening 22 (FIG. 9) is defined by marginal material 35 (FIG. 5A) formed along a center of the work surface 21. The U-shaped beam 36 (FIG. 5A) comprises a U-shaped structural trough having a bottom wall 37, sidewalls 38 and 39, and attachment flanges 40 and 41. The attachment flanges 40 and 41 are attached to an underside of the marginal material 35 of work surface 21 forming the central opening 22, such as by screws or the like, and also are attached to the legs 31 to stabilize the legs 31. The support channel 26 includes one or more stands 42 (FIG. 5A) that sit on the bottom wall 37 between the sidewalls 38 and 39. One or more stands 42 can be used, depending on a length of the work surface 21. For example, three stands 42 are used in the illustrated table 20 of FIG. 4A.

Each stand 42 includes an inverted U-channel 43 having a transverse top wall 44 that extends fully between the sidewalls 38 and 39, and further having short down flanges 45 and 46 that extend adjacent sidewalls 38 and 39 into engagement with the bottom wall 37. The inverted U-channel 43 mateably fits into a bottom of the trough 36 and rigidities the structural trough 36, providing a vertically stronger bottom portion as well as a torsionally stronger trough 36 that resists parallelogramming. Two opposing C-channels 47 and 48 are attached to the top wall 44 of the inverted U-channel 43 in spaced-apart and outwardly facing positions. The C-channels 47 and 48 each include a bottom attachment flange 49 attached to the transverse top wall 44, and include up flanges 50 and outwardly extending top flanges 51. The up flanges 50 include tall portions 52 (FIG. 4A) at each end of C-channels 47 and 48 that extend to a height equal to a top edge of the sidewalls 38 and 39. However, large notches 53 are formed in the up flanges 50, leaving short up flanges or dividers 54 along a length of the stand 42. The space between up flanges 50, up to a height of the short flanges 54, defines the central wireway 27, while the spaces outboard of the up flanges 50, up to a height of the short flanges 54, defines the side wireways 28 and 29. The up flanges 54 separate the central wireway 27 from the side wireways 28 and 29, and are covered a substantial portion of their length by the bottom panels 57 and 58 of the utility modular frame 55 discussed below. Notches 53' in the ends of the up flange tall portions 52 also allow wires to be routed laterally as desired.

A removable utility module 30 (FIG. 4A) fits into the notch 53 and is positioned on each one of the stands 42, which includes three modules 30 in the illustrated support channel 26. The utility module 30 includes a W-shaped sheet metal modular frame 55. The modular frame 55 includes an inverted U-shaped center section 56, bottom panels 57 and 58 on each side thereof, and inverted L-shaped end sections 59 and 60 on the outer ends of bottom panel sections 57 and 58. The center section 56 includes flat top panel 61 and inner vertical panels 62 and 63. The vertical panels 62 and 63 each have apertures 64 therein for receiving and supporting first utility outlets 65, such as snap-attach telephone outlet jacks with telecommunication wiring 66 extending therefrom. The L-shaped end sections 59 and 60 have outer vertical panels 67 and horizontal end panels 68. The outer vertical panels 67 each have apertures 69 therein for receiving and supporting second utility outlets 70, such as snap-attach power outlets with electrical power wiring 71 extending therefrom. As illustrated, the flat top panel 61 of center section 56 is parallel but spaced below a height of the horizontal end panels 68.

Figure 5:
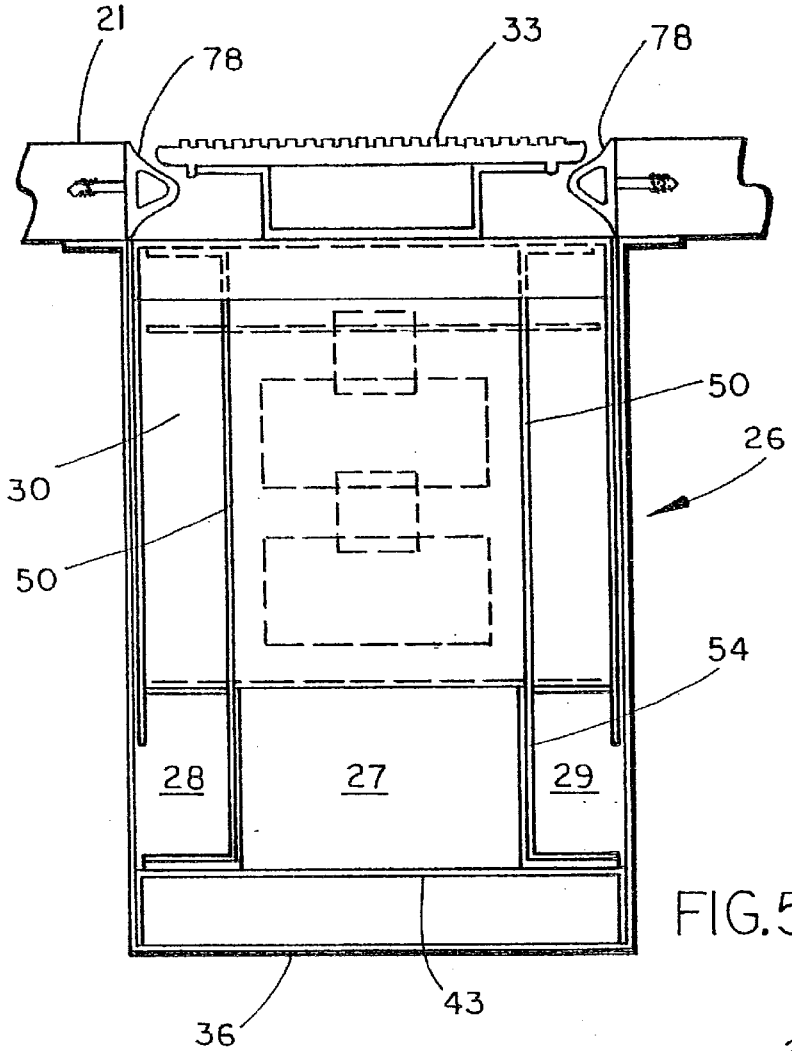
FIG. 5 is an enlarged, fragmentary end view of the utility distribution system shown in FIG. 4A.
Figure 5A:
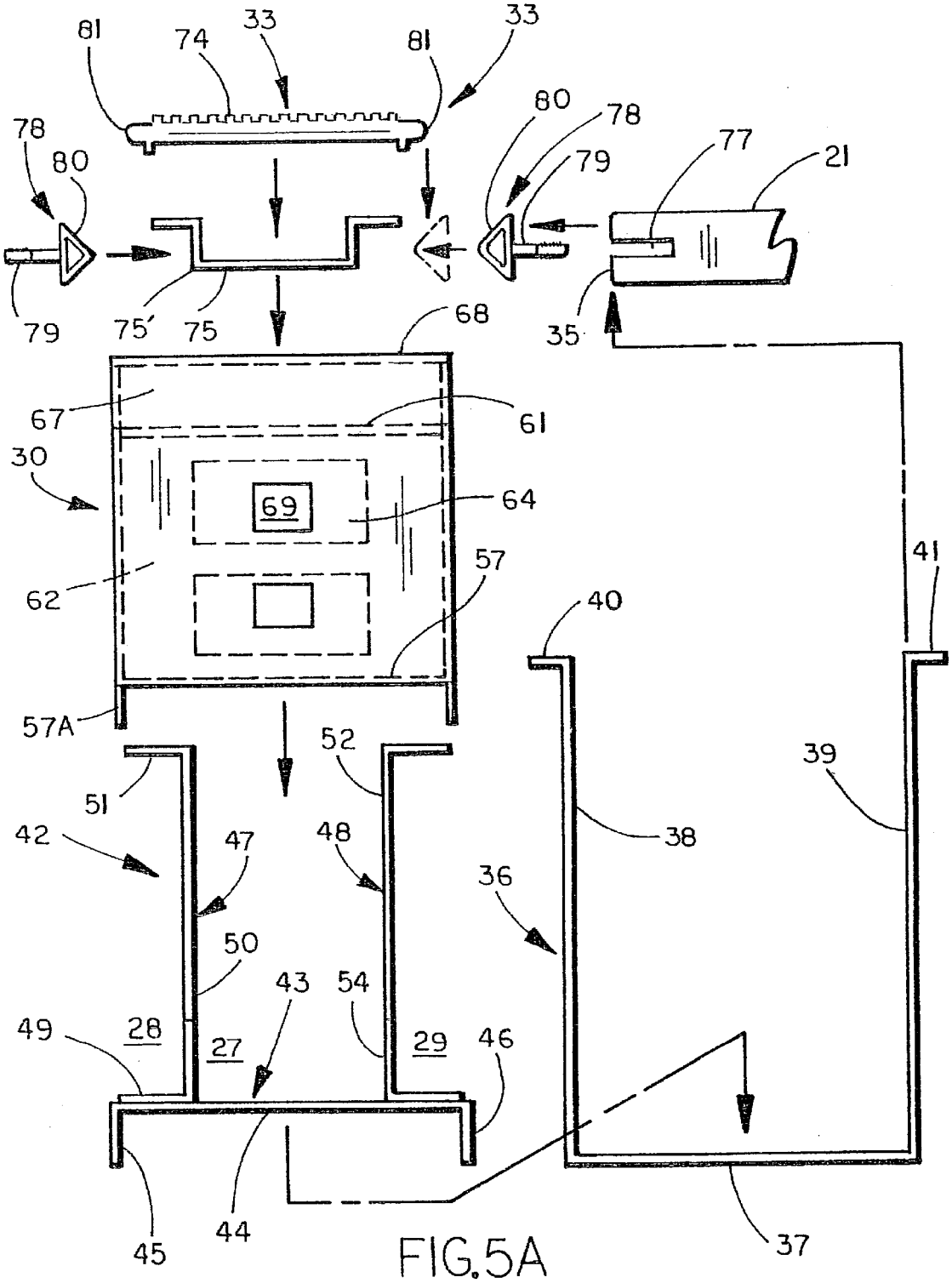
Figure 6:
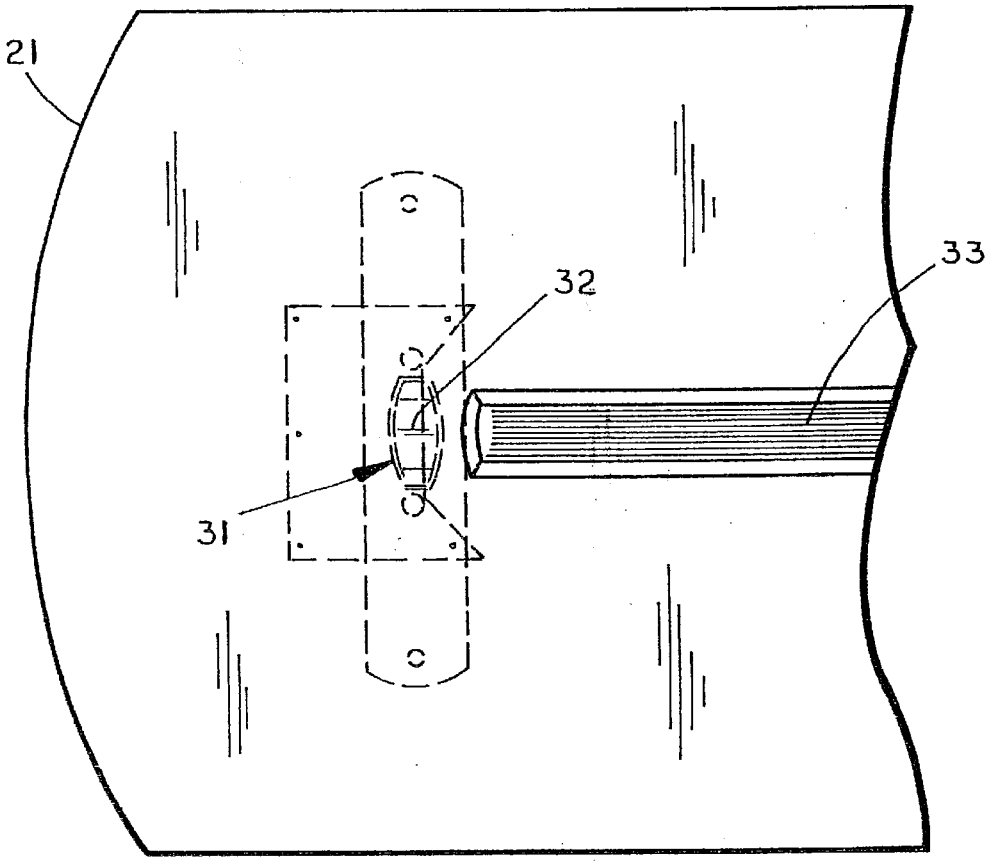
FIGS. 6 and 7 are fragmentary top and side views of the conference table shown in FIG. 1.
Figure 7:
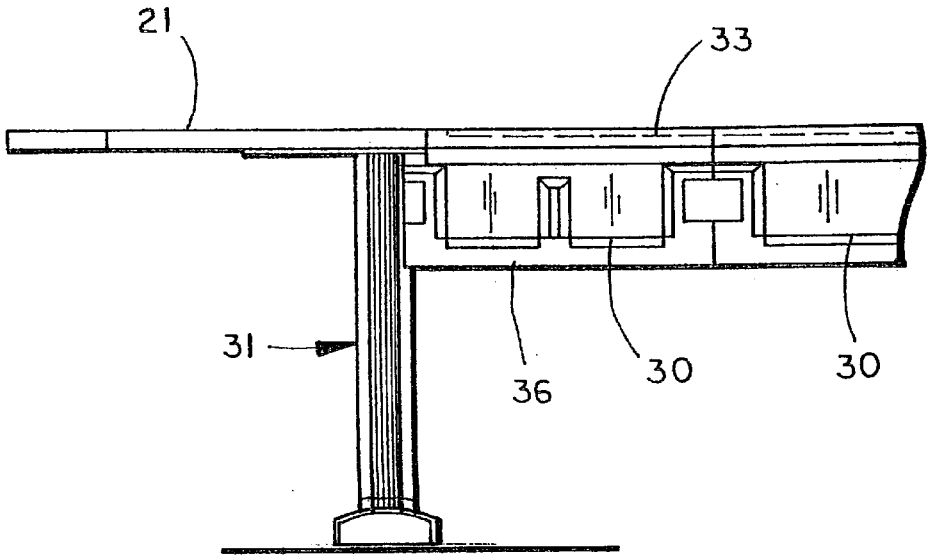

The end panels 68 have a down flange 72 at their free end, which down flange 72 abuts another down flange 72 on an adjacent modular frame 55. Perpendicular stiffening flanges (see for example stiffening flange 57A) also extend from each side of the panels 57–58, 61–63, and 67–68, respectively, to rigidify the panels. The vertical panels 62 and 63 are spaced apart and define a space therebetween for housing the first utility outlets 65, with the wiring 66 extending laterally outwardly over the short flange 54 into one of the side wireways 28 or 29 (FIG. 5). The end panels 68 (FIG. 4A) are long enough, such that abutting end panels 68 of adjacent modular frames 55 create a space between adjacent vertical panels 67 for housing the second utility outlets 70, with the wiring 71 extending downwardly into the central wireway 27. In this way, the wiring 66 and 71 is laid into their respective wireways 27–29. When the modular frames 55 are set into the support channel 26, the bottom panels 57 and 58 rest on the top edges of the short flanges 54, thus capturing (i.e., retaining) the wiring 66 and 71 in their respective wireways 27–29. End-located notches 53' in the tall portions 52 of the up flanges 50 allow the wiring 66 to extend from a center area outboard of the up flanges 50, if it is desirable to route the wiring 66 to one of the side wireways 28 or 29. The shape of the up flange 50 in combination with the shape of the modular frame 55 (including its panels 57–58, 61–63, and 67–68, and their stiffening flanges) cause the routing of wiring 66 and 71 into the wireways 27–29 to be easily accomplished and to be particularly securely held in the wireways.

The illustrated covers 33 (FIG. 5A) include a body panel 74 (which can be wood, glass, plastic, or other materials) attached to a hat-shaped box 75. The box 75 extends low enough to nest between the end panels 68 of a particular modular frame 55. The box 75 also is designed to rest on the flat top panel 61 of the center section 56, if desired. Preferably, the box 75 is short enough to assure that it maintains the covers 33 in a flat flush position relative to the worksurface 21. The friction-retained covers 33 provide excellent alignment of the covers 33, while allowing them to be made of relatively lightweight materials and with a low total mass. A slot 77 is cut into an inwardly facing side of the marginal material 35, and a resilient light seal 78 is provided having a stem 79 that frictionally engages the slot 77. A bulbous end 80 of the light seal 78 provides a surface for an edge 81 of the plastic body panel 74 to rest on, thus eliminating the possibility of someone seeing through a gap into the trough 36.

Figure 8:
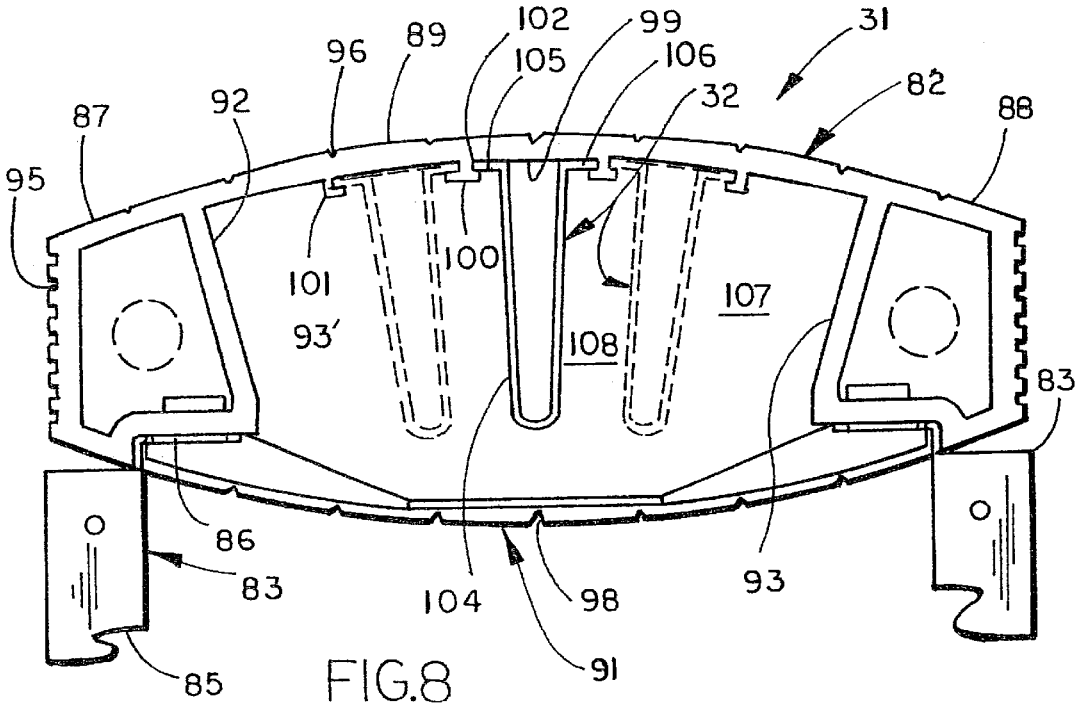
FIG. 8 is a cross-sectional view of one of the legs shown in FIG. 1.
Figure 12A:
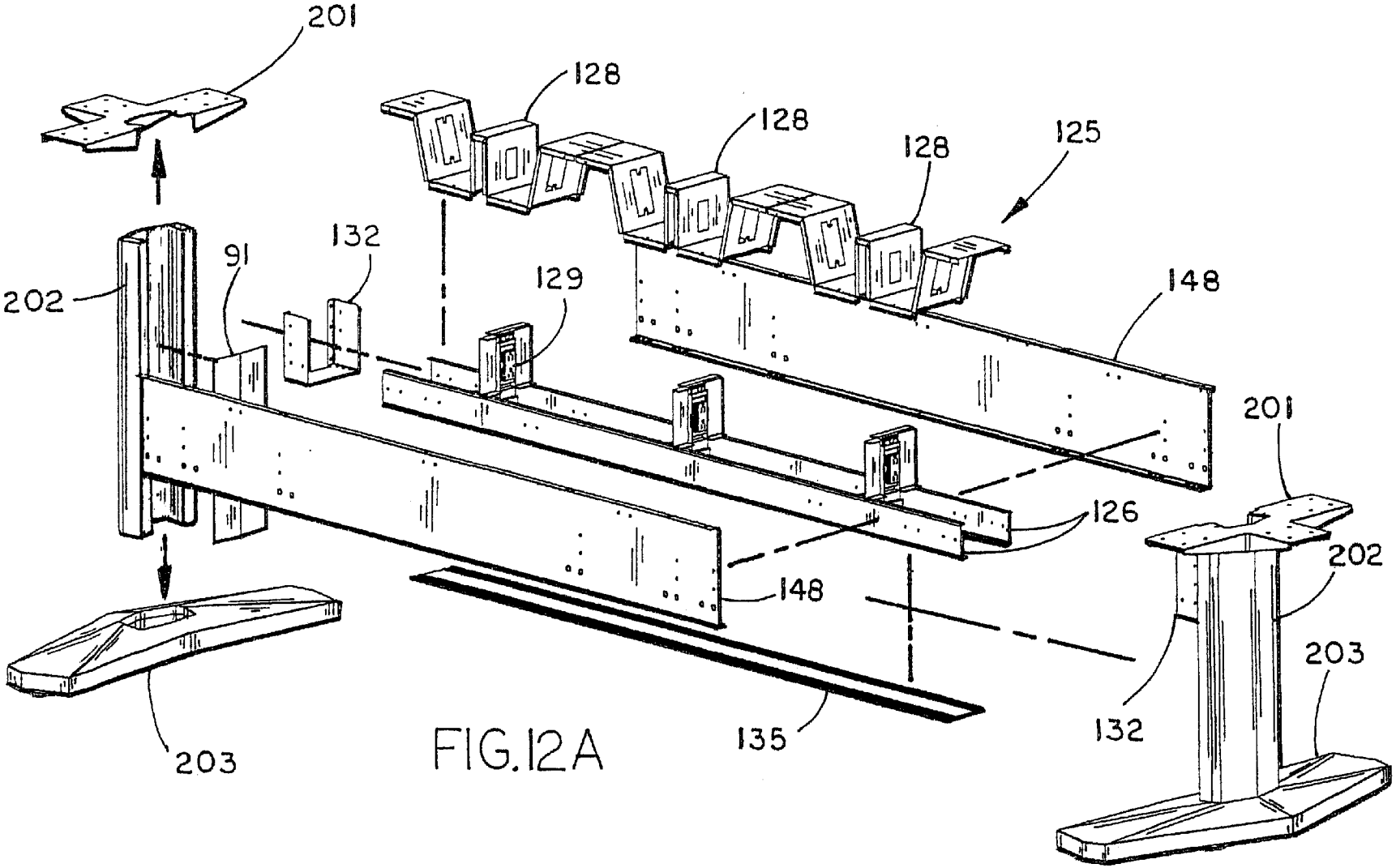
FIG. 12A exploded view similar to FIG. 17, but showing the tubular legs of FIG. 1.

Two tubular legs 31 (FIG. 8) include an extrusion 82 secured to the work surface 21 by a pair of brackets 83 and/or a bracket casting 201 (see FIG. 12A). The brackets 83 (FIG. 8) are L-shaped, with a first attachment flange 85 extending from a first leg of the bracket 83 for attachment to the work surface 21, and a second attachment flange 86 extending from a second leg of the L-shaped body 84 for attachment to one of the tubular end sections 87 or 88 of extrusion 82. The extrusion 82 includes tubular end sections 87 and 88 connected together with an arcuate wall 89. The tubular shape of end sections 87 and 88 add torsional stiffness to the legs 31. An aesthetic cover panel 91 is secured between the tubular sections 87 and 88. Depending on its strength, cover panel 91 further strengthens the extrusion 82. The tubular end sections 87 and 88 include inner walls 92 and 93, respectively. The inner walls 92 and 93 form a cavity 93' with the arcuate wall 89 and the cover panel 91 for communicating wiring 66 and 71 through the legs 31. The tubular end sections 87 and 88 also include exterior surfaces with vertical feature lines 95 and 96 that provide an excellent visual effect with the feature lines 98 on the cover panel 91.

An inside surface on the arcuate wall 89 (FIG. 8) includes T-shaped protrusions or tabs 100 and L-shaped protrusions 101 that define pairs of cavities 102 adjacent the inside surface 99. The divider 32 includes a U-shaped resilient body 104 and opposing feet 105 and 106. The feet 105 and 106 are configured to selectively slip into the cavities 102. By squeezing the U-shaped resilient body 104, the feet 105 and 106 disengage from the two protrusions 100 and 101. The divider 32 is repositioned by locating the divider 32 in a new pair of protrusions 100 and 101, and then releasing the body 104 so that the feet 105 and 106 re-engage a selected new pair of cavities 102. This arrangement allows one or more of the dividers 32 to be selectively located in the legs 31 to achieve a pair of dissimilarly sized wireways inside the legs 31. Thus, the internal wireways can be optimally selectively sized to carry wiring bundles having dissimilar cross-sectional sizes.

Figure 8A:
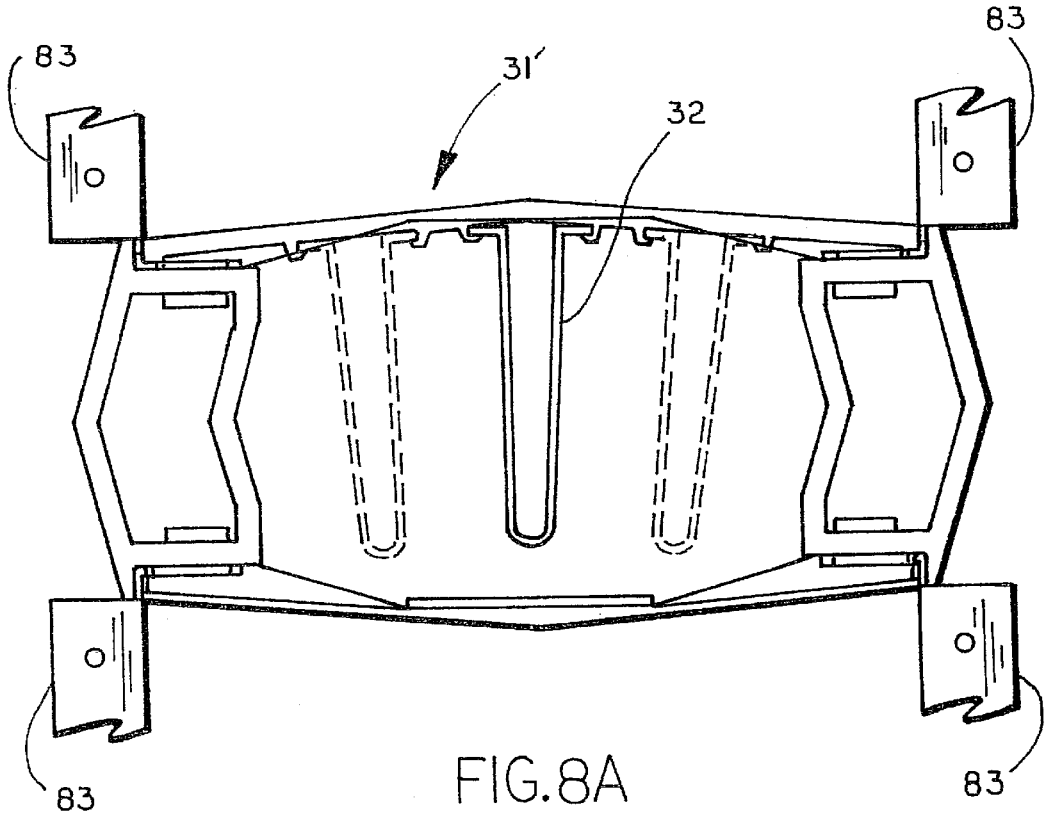
FIG. 8A is a cross-sectional view of a mid-leg for a three-leg table.

A mid-leg 31' (FIG. 8A) has a construction similar to leg 31, including a repositionable divider 32. The mid-leg 31' is used on a table requiring three legs.

Figure 10:
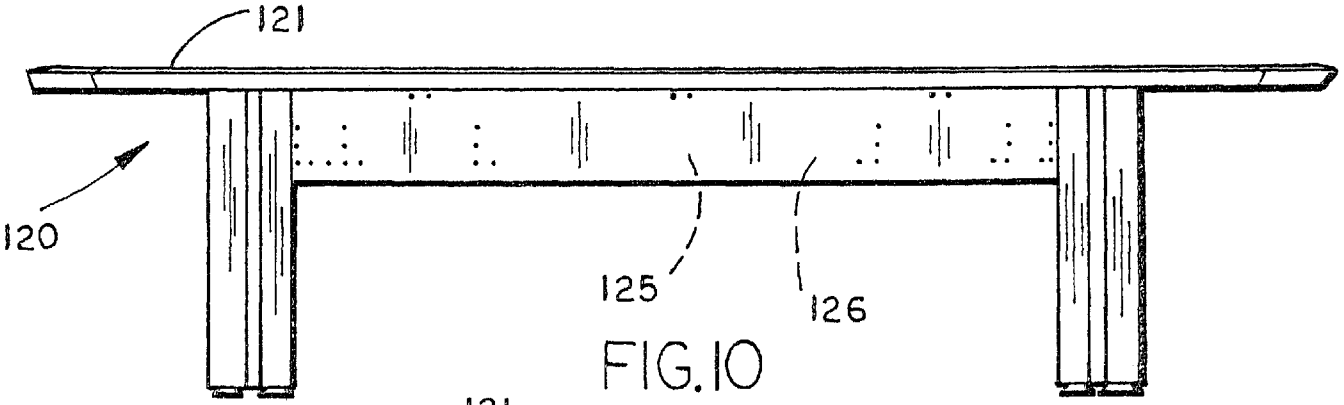
FIGS. 10 and 11 are side and top views of a second conference table embodying the present invention.
Figure 11:
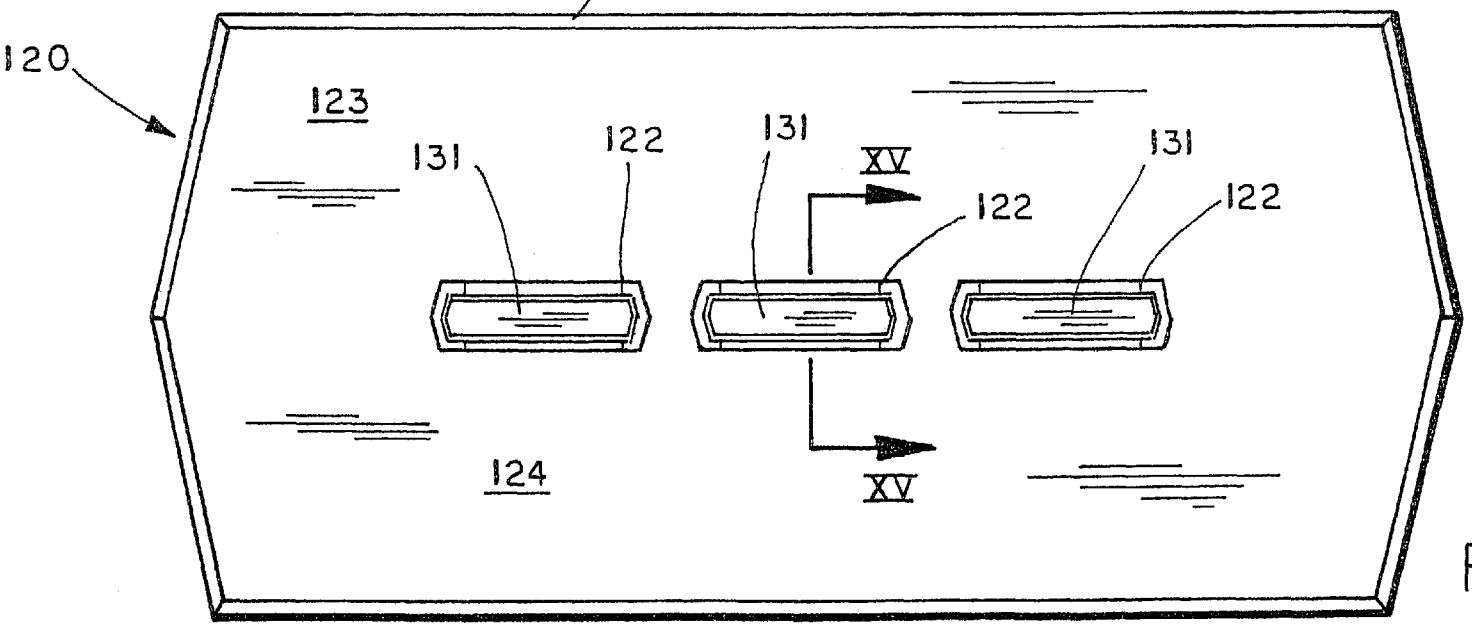

A second conference table 120 (FIGS. 10 and 11) embodying the present invention includes an elongated work surface 121 having one or more elongated central openings 122 dividing the work surface 121 into half sections 123 and 124. Each half section 123 and 124 includes at least one work area large enough for a person to comfortably work at while at the conference table 120. A utility distribution system 125 (FIG. 12) is positioned below the one or more elongated central openings 122 and is supported on a pair of opposing C-shaped beams 126 (sometimes referred to as support channels herein). The C-shaped beams 126 rigidly interconnect a pair of legs 127 that support the work surface 121 to form a leg assembly, with the legs 127 being located at and attached to each end of the beams 126. The illustrated legs 127 are about 24 to 30 inches wide. It is noted that they can be several different shapes and sizes. The utility distribution system 125 includes modular W-frames 128 that receive first utility outlets 129 and supports second utility outlets 130, as described below. A novel cover arrangement 131 covers the central opening 122 to provide an aesthetic covering. Notably, the cover 131 is openable in either of two directions to provide easy access to the outlets 129 and 130, and can be left in a propped open position or removed to facilitate repair or addition of new utilities.

Notably, the "T" legs 31 can also be used to replace the "wide" legs 127, as shown in FIG. 12A. A cast aluminum bracket 201 is welded to extruded aluminum leg 202, which is welded to cast aluminum base 203. Brackets 132 are used to secure the remaining illustrated parts in place, which parts were previously described or are discussed below.

Figure 14:
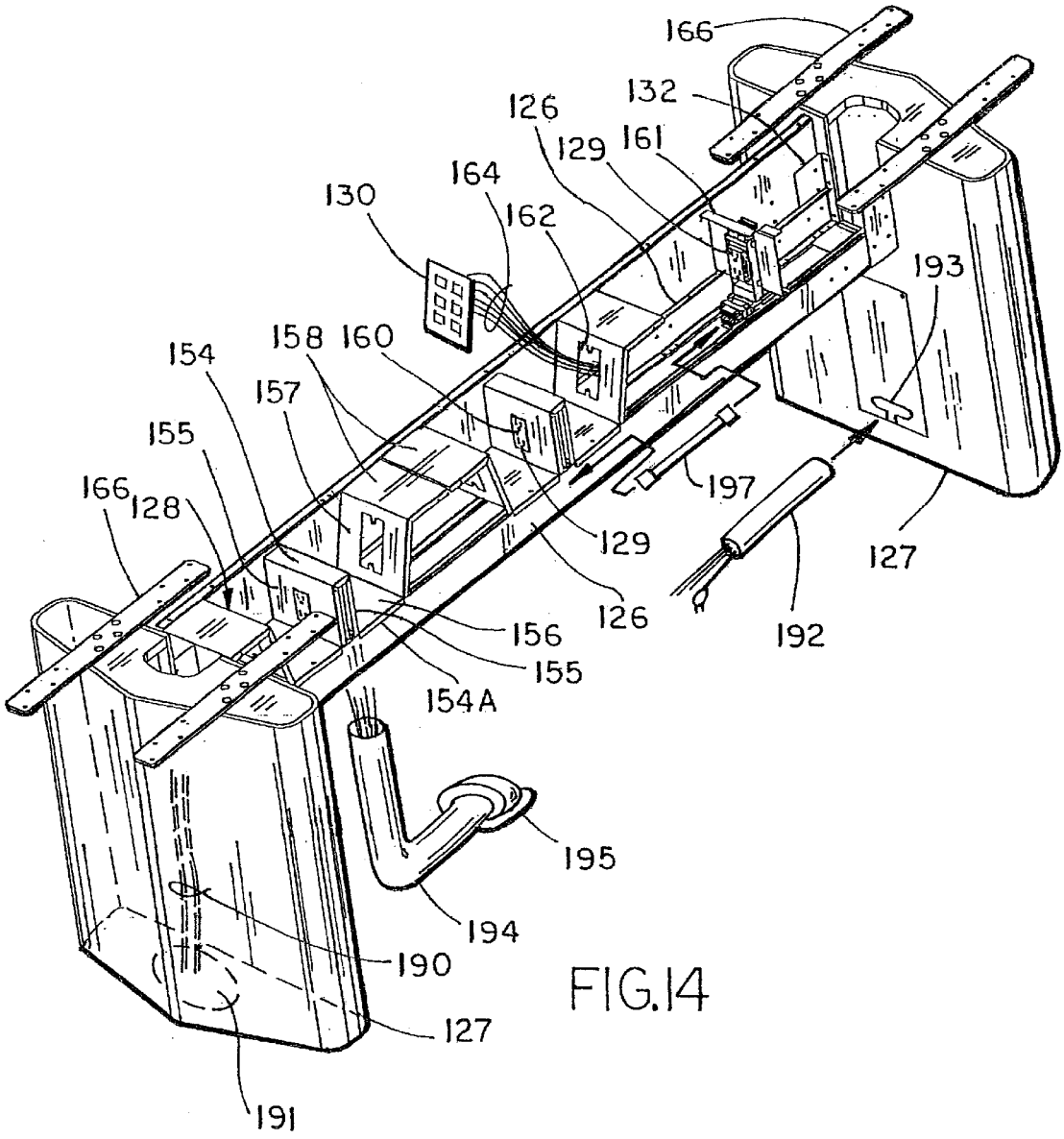
FIG. 14 is a perspective view of the leg assembly shown in FIG. 10, including the legs, the beams connecting the legs, and the utility distribution system supported on the beams.
Figure 15:
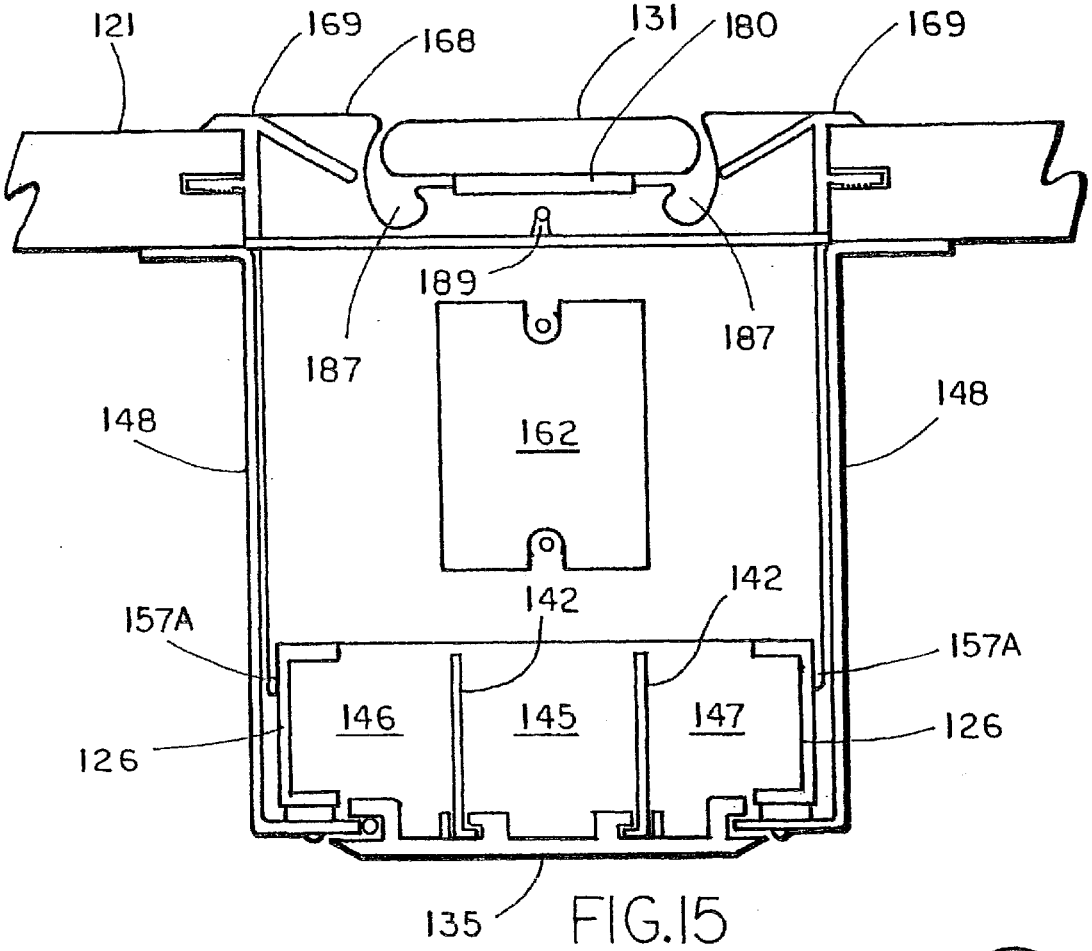
FIG. 15 is an enlarged end view of the utility distribution system shown in FIGS. 12 and 13, including the cover and the divided utility wireways between the beams.
Figure 17:
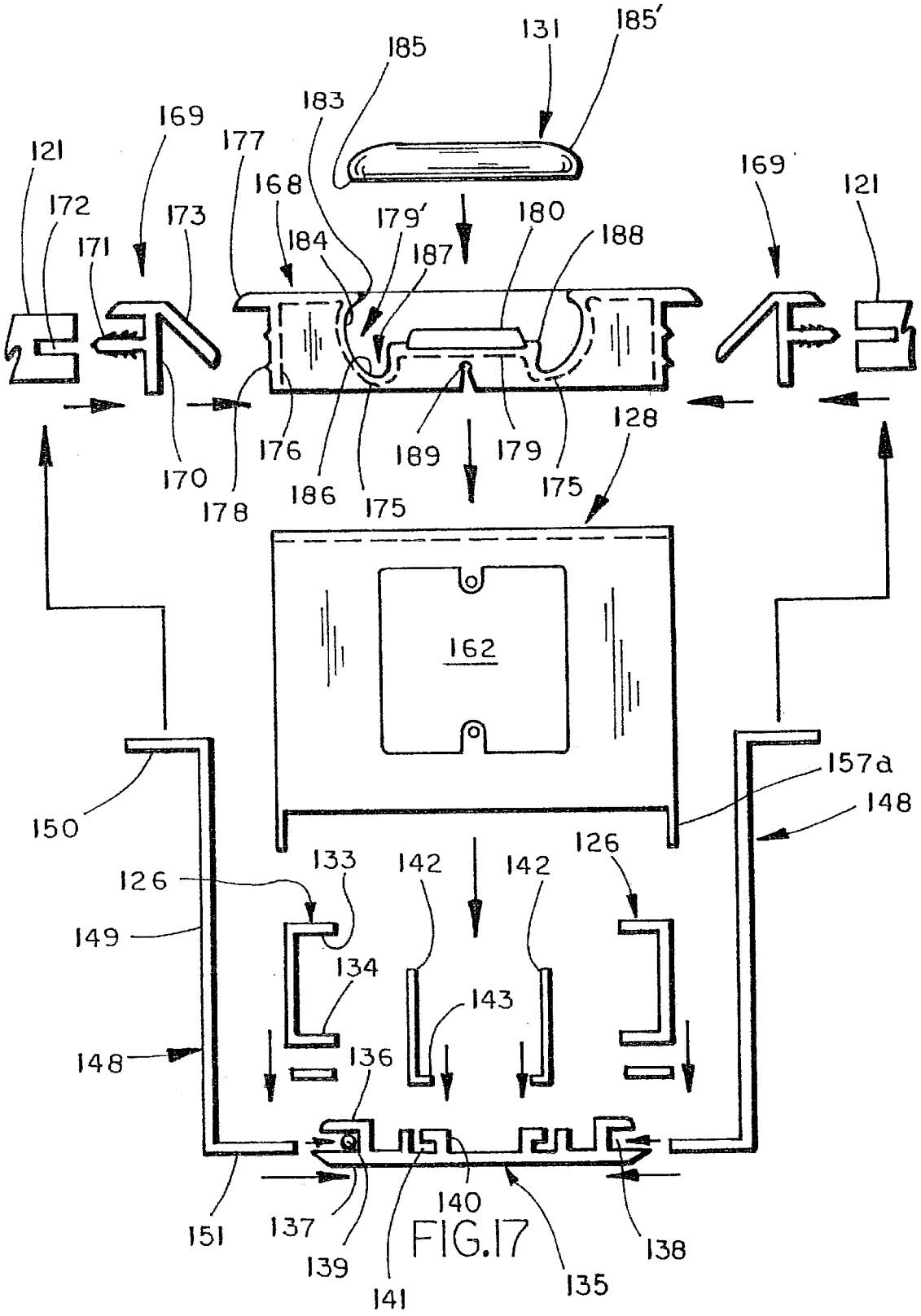
FIG. 17 is an enlarged view of the cover arrangement shown in FIG. 15.

The beams 126 (FIG. 14) extend between the tubular legs 127 and are rigidly secured to the legs 127 by U-brackets 132. The side covers 148 (FIG. 17) include a top flange 150 and a bottom flange 151 that faces inwardly. A bottom panel 135 includes a pair of attachment flanges 136 and 137 along each of its edges that form recesses 138 for receiving the bottom flanges 151. One of the recesses 138 includes a resilient tube or foam piece 139 that fills part of one of the recesses 138 on one side. When the bottom panel 135 is attached, the recess 138 with the tube 139 therein is placed on the respective bottom flange 151. The tube 139 is then compressed by shiftingly moving the bottom panel 135 so that the other bottom flange 151 can be positioned in the opposite recess 138. When the tube 139 expands, it expands only far enough to cause both bottom flanges 151 to be retained in their respective recesses 138, thus holding the bottom panel 135 on the side covers 148 (FIG. 15).

Two pairs of short tabs 140 (FIG. 17) extend upwardly from a top of the bottom panel 135 to define second recesses 141. Dividers 142 include a bottom foot 143 configured to mateably engage the recesses 141. When installed, the dividers 142 extend upwardly between the C-shaped beams 126, forming a central wireway 145 and side wireways 146 and 147 between the C-shaped beams 126 (FIG. 15). Side covers 148 (FIG. 17) include a large vertical panel section 149. The side covers 148 further include a top attachment flange 150 that attaches to the work surface 121 and a bottom attachment flange 151 that attaches to a bottom of the bottom flange 134 of the C-shaped beam 126.

Modular W-frames 128 (FIG. 14) rest on the C-shaped beams 126 under the work surface 121. The modular W-frames 128 include a center section defined by horizontal center top wall 154 and opposing vertical inner walls 155. A horizontal lateral bottom wall 156 extends from vertical inner walls 155, and outer angled walls 157 extend upwardly from lateral bottom wall 156. A horizontal outer top wall 158 extends from angled walls 157. The end of outer top wall 158 abuts with the end of an adjacent outer top wall 158, as shown in FIG. 14. The stiffening flanges extend perpendicularly from each of the walls 154–158, respectively. The stiffening flange 157A straddles the C-shaped beams 126, thus holding the W-frames 128 in position on the C-shaped beams 126. The vertical inner walls 155 include apertures 160 configured to receive first utility outlets 129. The illustrated outlets 129 are supported on anchors 161 attached to the beams 126. The vertical inner walls 155 are spaced apart, such that the wiring extending from the utility outlets 161 can be routed into one of the wireways 145–147 (FIG. 15). The angled walls 157 also include apertures 162, and second utility outlets 130 are releasably positioned in these apertures 162 with wiring 164 extending into one of the wireways 145–147. Optimally, the utility outlets 130 are configured to snap or fasten into the apertures 162 and are configured to be snappingly removed therefrom for repair (see FIG. 14). It is noted that the W-frames 128 are symmetrical from end to end, such that they can be made by welding or fastening two identically shaped parts together at a center of the center top wall 154. Alternatively, they can be made from a single stamping.

Attached atop the tubular legs 127 are strap brackets 166 that extend horizontally and that provide for secure attachment of the work surface 121 to the legs 127. The strap brackets extend on inboard and outboard sides of the legs 127, and pairs of the brackets 166 include multiple attachment sites for securing the work surface 121.

The cover arrangement 131 (FIG. 13) includes end pieces 168 at each end of each central opening 122, and a pair of long flexible extrusions 169 that extends a length of the central opening 122. The extrusions 169 (FIG. 17) include a vertical wall 170 that abuts the marginal material of work surface 121 forming the central opening 122, and further includes an attachment stem 171 that extends into a slot 172 in the marginal material of work surface 121. A flexible flap 173 extends from the vertical wall 170 and is shaped to block light between the edges of the cover 131 and the marginal material forming the central opening 122 of the work surface 121. The end piece 168 includes a U-shaped outer section 176 that extends around an end of the central opening 122. A top lip 177 extends outwardly from the outer section 176 and is configured to rest on a top of the work surface 121 to support the end piece 168 in the central opening 122. Outwardly facing ridges 178 also frictionally engage the work surface 121 to retain the end piece 168 in position. A flat-topped cover support island 179 forms a plateau-like protrusion that extends longitudinally from a middle of the U-shaped outer section 176. Recess-forming walls 175 connect sides of the island 179 to the outer section 176, and form a pair of configured recesses 179' on opposing sides of the island 179. A resilient mat 180 of rubber (or potentially of foam) is positioned on the island 179 for supporting the cover 174 when the cover 174 is in a closed position. The resilient mat 180 also lets the cover 174 close in a quiet, "soft" manner.

Figure 16:
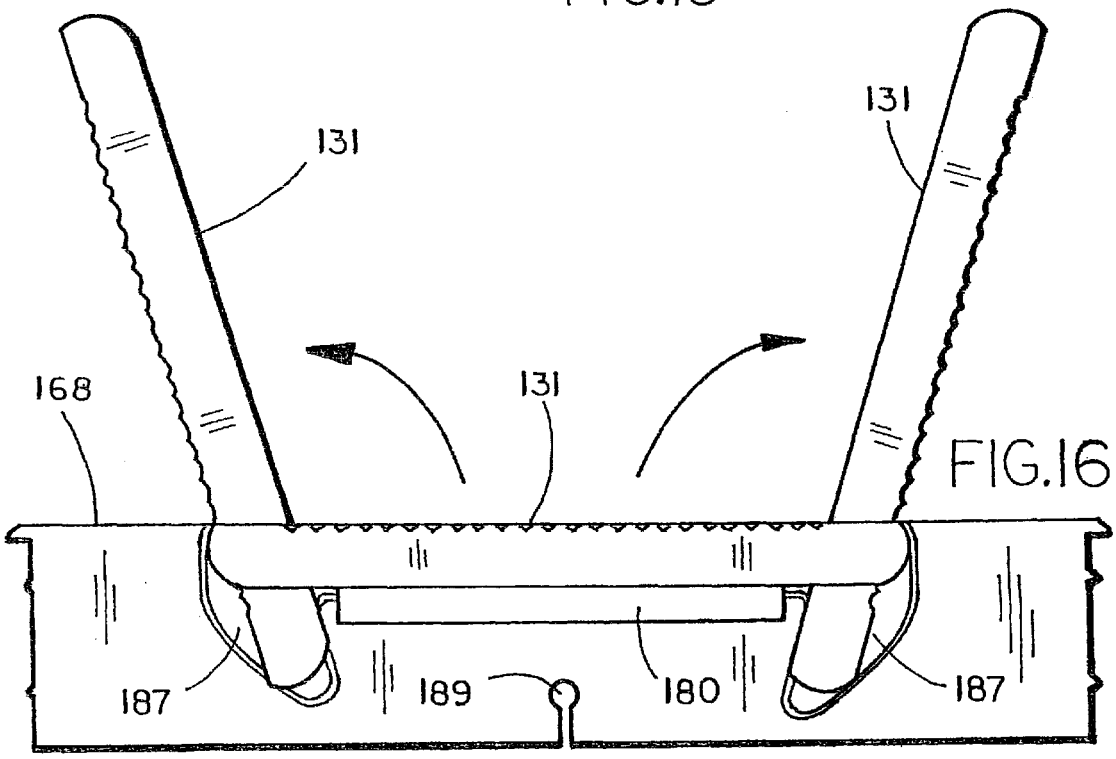
FIG. 16 is an end view showing the cover arrangement, with a closest cover being in the closed position, the second and third covers being in opposite propped open positions.

The recesses 179' are specially formed to allow the cover 174 to open and close in a predetermined manner (FIG. 16) and hold the cover 174 open in either a forwardly or rearwardly propped open position. The recesses 179' are formed by an outer curvilinear surface that defines an upper lip 183, a substantially vertical section 184, and a curvilinear lower section 186. The vertical section 184 provides for initial movement of an edge 185 (or edges 185') of the cover 174. The curvilinear lower section 186 causes the edge 185 (or edges 185') to sweep into a lower pocket 187 as the cover 174 is further opened. The island 179 includes an outer edge 188 that acts as a virtual pivot for the cover 174 to rotate on, as the cover 174 is opened and closed. Starting from the closed position (FIG. 16), a person pulls on the edge 185 of the cover 174, causing the edge 185' to move downwardly toward the pocket 187. The opposite edge 185' of the cover 174 frictionally snaps downwardly past the lip 183, providing a detent-like feel upon closing (or opening) the cover 174. Specifically, to close the cover 174, a person presses on the edge 185' causing the cover 174 to frictionally snap downwardly past the lip 183, providing a detent-like feel upon closing the cover 174. The cover 174 pivots about the pivot 188, with the edge 185 moving into the pocket 187. With the edge 185 in the pocket 187, the cover 174 is propped open in a slightly outwardly angled vertical position, where it rests against the upper outer lip 183. Notably, the recesses 179' are identical, such that the cover 174 can be easily pivoted in either direction. A keyhole 189 is provided in the end piece 168 for receiving a cable to tether the cover 131 to the end piece 168 so that the cover 131 does not become lost or misplaced.

Wiring can be routed into the conference table 120 in a number of different ways. Wiring 190 can be routed from a floor outlet 191 (FIG. 14) directly upwardly into a bottom of the tubular leg 127, or can be routed by wiring 192 through a side opening 193 into a side of the tubular leg 127. Also, wiring 194 can be extended from a floor outlet 195 upwardly through the bottom panel 135 into one of the wireways 145–147. Also, jumpers 197 can be used to connect utility outlets to each other, where utility outlet modules are used in series.

Figure 18:
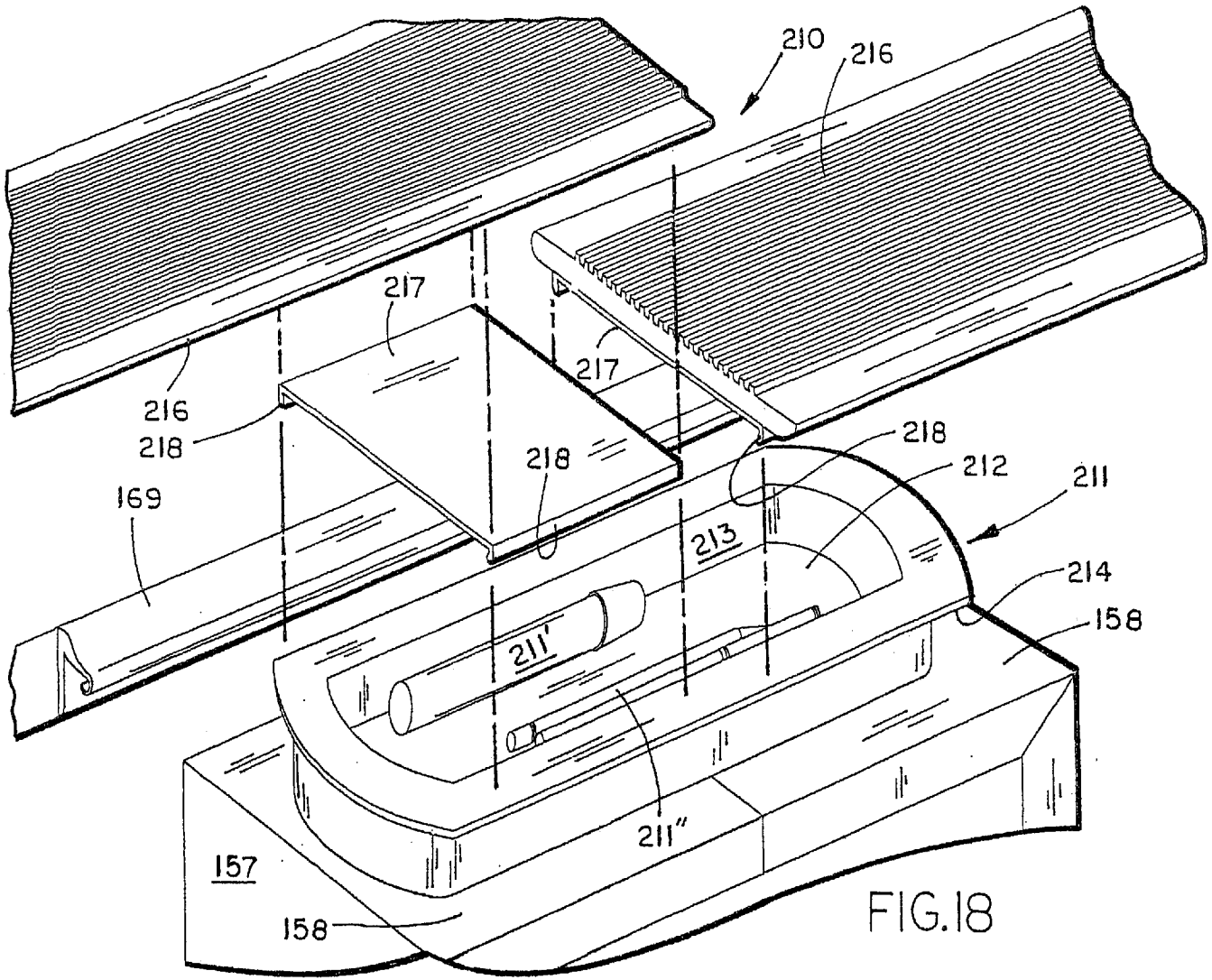
FIG. 18 is an enlarged exploded perspective view showing a cover attachment arrangement integrated with a pencil holder tray.

A cover arrangement 210 (FIG. 18) incorporates a pencil tray holder 211 for holding markers 211', pencils 211", and the like. The holder 211 includes a bottom 212 attached to the top horizontal flange 158. Sidewalls 213 extend upwardly from bottom 212 and outwardly facing lips 214 are formed atop the sidewalls 213. Cover 216 is provided having a body panel and retainer or adapter 217 with attachment flanges 218 that snap attach to lips 214. Notably, it is contemplated that retainer 217 can be integrated into the body panel where the cover 216 is extruded metal or plastic, but that separate parts will be used where the body panel will be glass, wood, or the like.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A conference table comprising:

a leg assembly including first and second legs and a beam connected between and stabilizing the first and second legs;

a utility distribution system supported by the beam including utility outlets;

a tabletop supported by the leg assembly, including an elongated central opening over the beam for accessing the utility outlets;

including a top cover shaped to cover the central opening, and including cover supports in the central opening and attached to the tabletop that are constructed to pivotally support the top cover for movement between at least one opened position and a closed position where the top cover is co-planar with the tabletop;

wherein the cover supports define virtual pivots that support the top cover for pivotal movement without direct attachment to the top cover; and wherein the cover support is configured to support the top cover in a propped opened position in either of the two oppositely opened positions.

2. A conference table comprising:

a leg assembly including first and second legs and a beam connected between and stabilizing the first and second legs;

a utility distribution system supported by the beam including utility outlets;

a tabletop supported by the leg assembly, including an elongated central opening over the beam for accessing the utility outlets;

including a top cover shaped to cover the central opening, and including cover supports in the central opening and attached to the tabletop that are constructed to pivotally support the top cover for movement between at least one opened position and a closed position where the top cover is co-planar with the tabletop;

wherein the cover supports define virtual pivots that support the top cover for pivotal movement without direct attachment to the top cover; and wherein the cover supports comprise end pieces having shaped recesses configured to receive an edge of the top cover in a manner defining the virtual pivot.

3. The conference table defined in claim 2, wherein the shaped recesses include an inner lip that pivotally engages the top cover as the top cover is moved toward the opened position, and further include an outer lip that engages the top cover to prop open the top cover when the top cover is in the opened position.

4. The conference table defined in claim 2, wherein at least one of the first and second legs is tubular and includes a repositionable adjustable divider configured to subdivide a space in the one leg into separated wireways of different cross-sectional sizes.

5. A conference table comprising:

a leg assembly including first and second legs and a beam connected between and stabilizing the first and second legs;

a utility distribution system supported by the beam including utility outlets;

a tabletop supported by the leg assembly, including an elongated central opening over the beam for accessing the utility outlets; and wherein at least one of the first and second legs is tubular and includes a repositionable adjustable divider configured to subdivide a space in the one leg into separated wireways of different cross-sectional sizes.

6. The conference table defined in claim 5, including a top cover shaped to cover the central opening, and including cover supports in the central opening and attached to the tabletop that are constructed to pivotally support the top cover for movement between at least one opened position and a closed position where the top cover is co-planar with the tabletop.

7. The conference table defined in claim 5, including a top cover shaped to cover the central opening, and including cover supports in the central opening and attached to the tabletop that are constructed to pivotally support the top cover for movement between at least one opened position and a closed position where the top cover is co-planar with the tabletop.

8. The conference table defined in claim 7, wherein the cover supports comprise end pieces that support the top cover for opening movement in two different ways.

9. The conference table defined in claim 7, wherein the cover supports define virtual pivots that support the top cover for pivotal movement without direct attachment to the top cover.

10. The conference table defined in claim 5, including beam covers attached to the beam.

11. The conference table defined in claim 5, including wireways defined in the beam.

12. The conference table defined in claim 11, including beam covers attached to the beam.

13. The conference table defined in claim 5, including a cover shaped to cover the opening and a cover support operably supporting the cover for opening movement in either of two different directions.

14. The table defined in claim 13, wherein the cover support defines a recess configured to hold the pencils and the like under the cover.

15. The table defined in claim 13, wherein the opening is elongated, and including light seal flaps that extend along both sides of the elongated opening to prevent visual access along sides of the cover into the elongated opening when the cover is in the closed position.

16. The table defined in claim 13, wherein the cover support includes end pieces having a cover-supporting surface constructed to support the cover in a horizontal closed position over the opening, the cover support including at least one recess configured to receive an edge of the cover as the cover is pivoted to an opened position.

17. The table defined in claim 16, including a rubber dampener on the up protrusion configured to soften movement of the cover to the closed position.

18. The table defined in claim 17, wherein the at least one recess is configured to hold the cover in a propped cantilevered manner when the cover is in one of the opened position.

19. The table defined in claim 16, wherein the at least one recess is configured to receive an edge of the cover and provide a lip that acts as a fulcrum, so that a person can flip open the cover by pulling on the edge.

20. The table defined in claim 16, wherein the at least one recess includes a lip that frictionally snappingly engages the cover when the cover is in the closed position.

21. The table defined in claim 16, wherein the end pieces include an up protrusion configured to engage and support a bottom of the cover when the cover is in the closed position.

* * * * *

UNITED STATES PATENT AND TRADEMARK OFFICE

CERTIFICATE OF CORRECTION

PATENT NO. : 6,629,505 B1 
DATED : October 7, 2003
INVENTOR(S) : Jeffrey P. Cronk et al.

It is certified that error appears in the above-identified patent and that said Letters Patent is hereby corrected as shown below:

Column 2,
Line 29, "as" should be -- an --.
Line 49, after "12A" insert -- is an --.

Column 3,
Line 63, "table 20º)" should be -- table 20') --.

Column 4,
Line 17, "rigidities" should be -- rigidifies --.

Column 9,
Line 16, "support is" should be -- supports are --.

Column 10,
Line 52, delete "one of".

Signed and Sealed this

Twenty-second Day of June, 2004

JON W. DUDAS
*Acting Director of the United States Patent and Trademark Office*